United States Patent [19]

Johnson

[11] 4,082,312

[45] Apr. 4, 1978

[54] CROSS COUNTRY SKI BINDING

[76] Inventor: Lennart B. Johnson, Federal Hill Rd., Milford, N.H. 03055

[21] Appl. No.: 725,173

[22] Filed: Sep. 21, 1976

[51] Int. Cl.[2] ..... A63C 9/10

[52] U.S. Cl. ..... 280/615

[58] Field of Search ..... 280/615, 614, 607, 636

[56] References Cited

U.S. PATENT DOCUMENTS

| | | | |
|---|---|---|---|
| 3,907,319 | 9/1975 | Berlied | 280/615 |
| 3,920,257 | 11/1975 | Fredriksen | 280/615 |
| 3,979,131 | 9/1976 | Ginther | 280/615 |
| 4,004,823 | 1/1977 | Pyzel et al. | 280/615 |

*Primary Examiner*—Joseph F. Peters, Jr.
*Assistant Examiner*—Gene A. Church

[57] ABSTRACT

A cross country ski binding with a first unit adapted to be fixedly mounted on a boot toe thickness and a second unit adapted to be fixedly mounted on a ski, the two being selectively attachable to provide great forward flexibility and very slight lateral flexibility.

3 Claims, 6 Drawing Figures

FIG 1
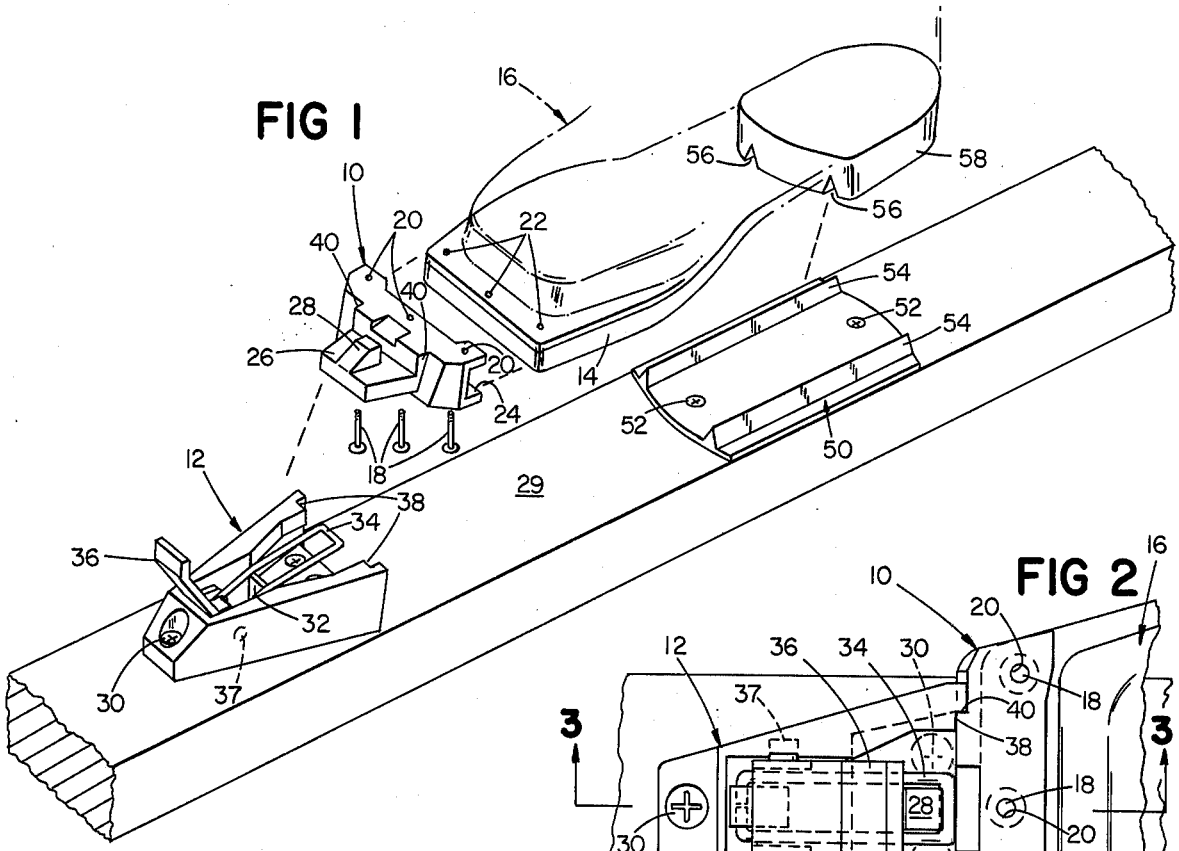
FIG 2
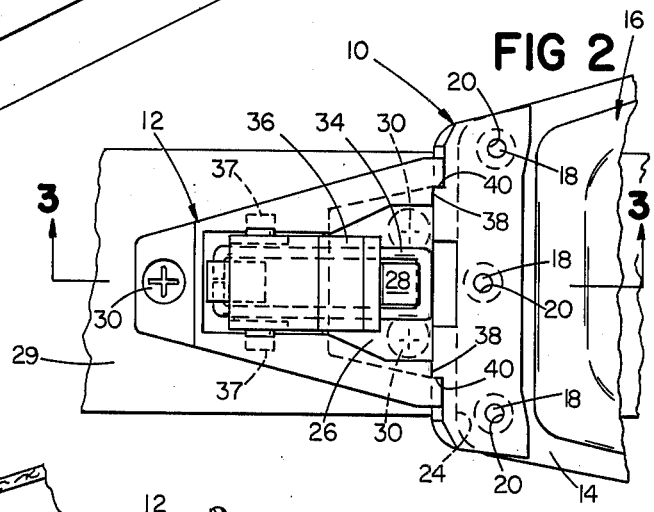
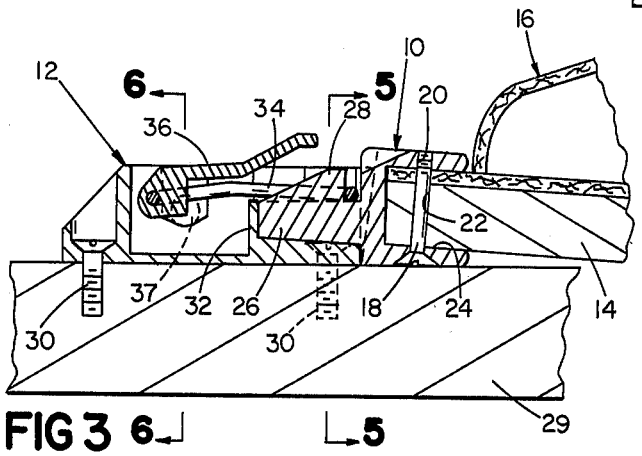
FIG 3 6 5
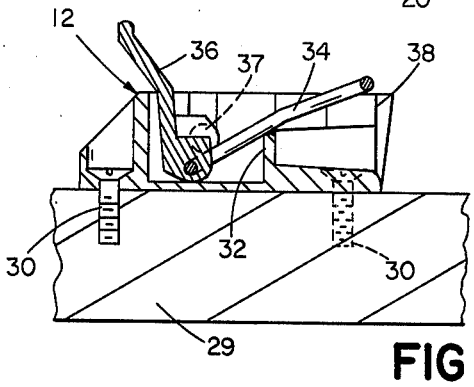
FIG 4
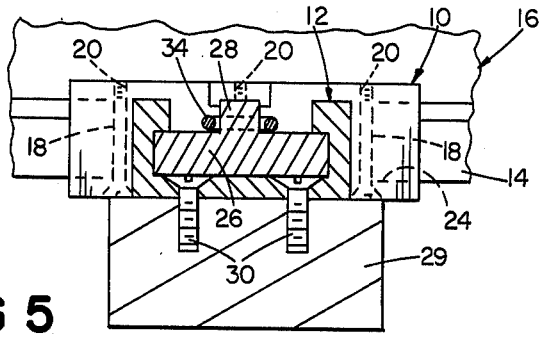
FIG 5
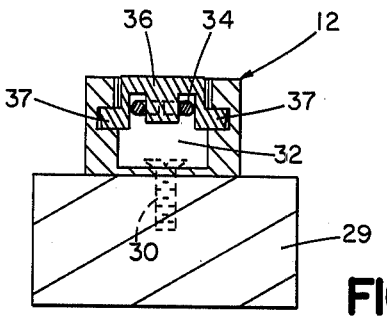
FIG 6

CROSS COUNTRY SKI BINDING

This invention relates to cross country ski bindings, particularly for racing on prepared tracks.

BACKGROUND OF THE INVENTION

There has long been need of a more satisfactory cross country ski binding.

One type in wide use is disclosed in With U.S. Pat. No. 3,481,618, "Ski Binding Of The Toe Binding Type", and involves using spring bales to capture the side and toe portions of boot soles. Not only is fit a problem, in view of the myriad different boot sizes, but improved lateral (Y-axis) stability with this construction requires a tightness of side flange fitting inconsistent with desired good forward (up-and-down Z axis, movement of heel) flexibility. A broadly similar construction is shown in Dysthe U.S. Pat. No. 3,874,684, "Ski Toe Binding", in which the two inner ends of the toe-clamping bale may be removed from holes in the binding, to release, by pushing down on the toe end of the bale, as with a ski pole. Sollentune et al. U.S. Pat. No. 3,612,558, "Holding Element For Ski Boot", teaches mounting a unit on a boot toe for cooperation with a bale to prevent rearward (X-axis) and upward movement of the toe, but Y-axis movement is attempted to be contained in the same old way. Hilding U.S. Pat. No. 3,003,777, "Ski Binding", discloses a binding with cooperating ski- and boot-mounted units, but the boot-mounted portion is mounted on the bottom of the boot, rather than on the thickness of the sole, inter alia. Finally, I understand that to some extent special boots have been made, using bootmaking techniques, to cooperate with ski-mounted binding units.

SUMMARY OF THE INVENTION

The invention features a two part ski binding, one part mounted on a boot toe and the other part mounted on a ski, the two being selectively engageable to lock the boot on the ski to secure it against both X-axis and Y-axis movement, while at the same time, as to Z-axis movement, permitting no such movement at the toe while permitting absolutely unrestrained such movement at the heel. In preferred embodiments, both parts are made wholly or in part of high impact plastic, X-axis movement is prevented (along with toe Z-axis movement) by a ski-mounted unit spring crank cooperating with a boot-mounted unit protuberance, and Y-axis movement is prevented by a pair of stops carried on the ski-mounted unit.

In another aspect, undesired Y-axis movement at the heel is selectively prevented by means of heel recesses cooperating with mating protuberances of a heel fixture.

The invention advantageously makes possible a lighter (combined boot and binding) weight, improved heel Z-axis flexibility, improved toe Y-axis stability, a binding more narrow than the ski, to cut drag, a perfect fit whatever shoe size, and mounting on the least variable portion of a boot (sole thickness).

PREFERRED EMBODIMENT

We turn now to drawings and description of a preferred embodiment of the invention.

DRAWINGS

FIG. 1 is an exploded, isometric, partially broken-away view of the presently preferred embodiment of the invention;

FIG. 2 is a plan view of a portion thereof;

FIG. 3 is a section view, taken at 3—3 of FIG. 2;

FIG. 4 is a sectional view, correspondingly taken, but showing the ski-mounted unit in detached position;

FIG. 5 is a sectional view, taken at 5—5 of FIG. 3; and

FIG. 6 is a sectional view, taken at 6—6 of FIG. 3.

DESCRIPTION

The boot-mounted portion of the binding is indicated generally at 10, and the ski-mounted portion at 12.

Binding unit 10 is secured on toe sole portion 14 of boot 16 by screws 18 extending through holes 20 and 22. Transversely of unit 10 is groove 24 of thickness to fittingly accept sole portion 14. Tongue portion 26, raised above ski 29 and carrying protuberance 28, extends in the opposite longitudinal direction.

Binding unit 12 is secured to ski 29 by screws 30. Upwardly and transversely extending wall 32 reinforces, and acts to move spring crank 34 upward when the binding is in open position. Spring crank 34 is pivotally mounted in cammed lever 36 for movement about pins 37 integral with lever 36 between the positions shown in FIG. 3 and FIG. 4. Transverse stop portions 38 stop tongue portion 36 when the binding is being engaged and engage unit 10 portions 40 to prevent, with wedge portion 26, Y-axis movement.

Both unit 10 and body 40 of unit 12 are molded of the high-impact nylon sold by DuPont under the designation ST-801.

Heel unit 50 mounted on ski 29 by means of screws 52 is adapted through its ridges 54 to cooperate with longitudinally extending grooves 56 provided in boot heel 58, so that when additional security against Y-axis movement at the heel is desired, as on turns, the heel may be brought down so that the ridges and grooves engage.

Operation

With the crank spring 34 and handle 36 in the position shown in FIG. 4, the crank spring 34 is hooked over protuberance 28 of unit 10 and the handle 36 moved to the position shown in FIG. 3, which moves crank spring 34 past dead center with respect to the axis about which it pivots, so that force thereon at protuberance 28 acts to hold the binding in attached condition. The handle 36 can be raised to detach the binding.

Other Embodiments

Other embodiments will occur to those skilled in the art. For example, Y-axis stability may be provided by other cooperating means in the toe- and ski-mounted binder units; attachment may be otherwise than by screws; and metal may be substituted for plastic.

What is claimed is:

1. A cross country ski binding comprising a toe unit adapted to be attached to the toe of a ski boot to extend longitudinally forwardly thereof and a ski unit adapted to be attached to the upper surface of a ski, said toe unit and said ski unit carrying mating stop surfaces cooperating by surface abutment to prevent any longitudinal and transverse relative movement when one of said stop surfaces is moved longitudinally relative to the other and said surfaces are locked together, and said toe unit and said ski unit carrying engageably cooperating locking means a portion of said locking means being movable generally perpendicularly to the longitudinal axis of said ski to lock together said stop surfaces, the rearward portion of said ski unit cooperating with the forward portion of said toe unit to transversely center said ski with forward movement of said toe unit.

2. The binding of claim 1 in which said toe unit is formed of high impact plastic.

3. The binding of claim 1 in which said ski unit is formed in part of high impact plastic.

* * * * *